US008800316B2

(12) United States Patent
Lee et al.

(10) Patent No.: US 8,800,316 B2
(45) Date of Patent: Aug. 12, 2014

(54) ICE MAKER AND REFRIGERATOR

(75) Inventors: Dong-Hoon Lee, Incheon (KR); Wook-Yong Lee, Bucheon-si (KR); Sung-Hoon Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 1044 days.

(21) Appl. No.: 12/375,831

(22) PCT Filed: Aug. 14, 2007

(86) PCT No.: PCT/KR2007/003905

§ 371 (c)(1),
(2), (4) Date: Oct. 21, 2009

(87) PCT Pub. No.: WO2008/023899

PCT Pub. Date: Feb. 28, 2008

(65) Prior Publication Data

US 2010/0031688 A1 Feb. 11, 2010

(30) Foreign Application Priority Data

Aug. 25, 2006 (KR) ..... 10-2006-0081072

(51) Int. Cl.
*F25C 1/04* (2006.01)
*F25C 1/10* (2006.01)

(52) U.S. Cl.
CPC ..... *F25C 1/10* (2013.01)
USPC ..... 62/353

(58) Field of Classification Search
CPC ..... F25C 1/08; F25C 1/10
USPC ..... 62/73, 74, 135, 137, 233, 340, 344, 62/345, 347, 353, 449, 351
See application file for complete search history.

(56) References Cited

U.S. PATENT DOCUMENTS

| | | | | |
|---|---|---|---|---|
| 5,177,980 | A * | 1/1993 | Kawamoto et al. | 62/353 |
| 6,050,097 | A | 4/2000 | Nelson et al. | |
| 2005/0072167 | A1* | 4/2005 | Oh | 62/137 |
| 2005/0241329 | A1 | 11/2005 | Castrellon et al. | |
| 2006/0117786 | A1* | 6/2006 | Lee et al. | 62/351 |
| 2006/0207282 | A1 | 9/2006 | Visin et al. | |

FOREIGN PATENT DOCUMENTS

| | | |
|---|---|---|
| JP | 05-099545 | 4/1993 |
| JP | 05-296623 | 11/1993 |

(Continued)

OTHER PUBLICATIONS

International Search Report dated Nov. 19, 2007.

(Continued)

*Primary Examiner* — Frantz Jules
*Assistant Examiner* — Emmanuel Duke
(74) *Attorney, Agent, or Firm* — Ked & Associates, LLP

(57) ABSTRACT

An icemaker is provided. The icemaker includes a water overflowing member capable of rotating together with a tray. With this structure, the overflowing of the water can be prevented, when the door is opened and closed and ice is discharged from the tray as the tray rotates.

9 Claims, 4 Drawing Sheets

(56) References Cited

FOREIGN PATENT DOCUMENTS

| | | | |
|---|---|---|---|
| JP | 05296623 | * | 11/1993 |
| JP | 06-011219 | | 1/1994 |
| JP | 06011219 | * | 1/1994 |
| JP | O6074624 | * | 3/1994 |
| JP | 06-273014 | * | 9/1994 |
| JP | 06273014 | * | 9/1994 |
| JP | 06331246 | * | 11/1994 |
| JP | 2829150 | | 11/1998 |
| KR | 20-0131512 | | 9/1998 |
| KR | 10-2005-0110209 | | 11/2005 |
| KR | 10-2005-0110211 | | 11/2005 |

OTHER PUBLICATIONS

Japanese Office Action dated Dec. 18, 2009.
European Search Report dated Apr. 29, 2013.
Korean Office Action dated Nov. 4, 2008.

* cited by examiner

ICE MAKER AND REFRIGERATOR

TECHNICAL FIELD

The present disclosure relates to an icemaker and a refrigerator.

BACKGROUND ART

Generally, an icemaker is a machine for making ice. The icemaker is installed in a refrigerator where the ice can be made by cold air.

The icemaker is installed in a freezing compartment. In this case, a storing space of the freezing compartment is reduced by a space occupied by the icemaker. Particularly, when the icemaker is structured such that ice cubes falls out of the icemaker as the icemaker rotates, the installation space of the icemaker further increases and thus the storing space of the freezing compartment is further reduced.

Therefore, the icemaker is sometimes installed in a door of the freezing compartment. In this case, the storing space can be sufficiently secured. However, when the icemaker is installed in the door of the freezing compartment, water stored in a tray of the icemaker may overflow when the door of the freezing compartment is opened and closed. Furthermore, the overflowing water is frozen and adhered to a surface of the icemaker and the door. The overflowing water may cause the damage of the icemaker.

In order to solve this problem, when the icemaker is installed in the door of the freezing compartment, a water overflowing preventing cover is installed on the icemaker. However, when the water overflowing preventing cover is installed on the icemaker, it is difficult to rotate the icemaker as the icemaker trips over the water overflowing preventing cover.

DISCLOSURE OF INVENTION

Technical Problem

Embodiments provide an icemaker that can prevent water from flowing over a tray when a door is opened and closed and allow the tray to rotate, and a refrigerator having the icemaker.

Embodiments also provide an icemaker that can prevent water from overflowing to a door and thus prevent the damage itself.

Technical Solution

In an embodiment, an icemaker includes a tray that is installed on a door to be rotated; a driving unit rotating the tray; and a water overflowing preventing member that is disposed around the tray to prevent the water from overflowing when the door is opened and closed, the water overflowing preventing member rotating together with the tray when the tray rotates.

In another embodiment, an icemaker includes a tray that is installed on a door to be rotated; a driving unit rotating the tray; and a water overflowing preventing member that is disposed at a door side or an opposite side of the door to prevent the water from overflowing when the door is opened and closed, the water overflowing preventing member rotating together with the tray when the tray rotates.

In still another embodiment, an icemaker includes a tray that is installed on a door to be rotated; a driving unit rotating the tray; and a water overflowing preventing member that is disposed around an upper portion of the tray to prevent the water from overflowing when the door is opened and closed, the water overflowing preventing member rotating together with the tray when the tray rotates.

In still yet another embodiment, a refrigerator includes a main body defining a storing compartment; a door opening and closing the storing compartment; a tray that is installed on a door to be rotated; a driving unit rotating the tray; and a water overflowing preventing member that is disposed around the tray to prevent the water from overflowing when the door is opened and closed, the water overflowing preventing member rotating together with the tray when the tray rotates.

In the above embodiments, the water overflowing preventing member may be disposed on a side of the tray, which ascends when the tray rotates.

Further, the water overflowing preventing member may be coupled to a hinge portion to be rotated.

In addition, a frame to which the tray is coupled to be rotated may be further provided. At this point, the water overflowing preventing member may be coupled to the frame.

The water overflowing preventing member may be returned to its initial position by self-gravity when the tray is returned to its initial portion.

A water overflowing preventing panel disposed at an opposite side of the tray to the water overflowing preventing member may be further provided.

An elastic member biasing the water overflowing preventing member to an initial position of the water overflowing preventing member may be further provided.

A lower portion of the water overflowing preventing member may contact a top surface of the tray.

Advantageous Effects

According to the present disclosure, since the water overflowing preventing member is disposed to rotate together with the tray, the overflowing of the water can be prevented when the door is opened and closed and the ice can be discharge from the tray as the tray rotates.

In addition, since the water overflowing preventing member is designed to be returned to it is initial position by self-gravity, the prevention of the water overflowing and the rotation of the tray can be realized by simply modifying a conventional structure.

Furthermore, since the overflowing of the water can be prevented, the contamination of food and short circuit that are caused by the overflowing water can be prevented.

BEST MODE FOR CARRYING OUT THE INVENTION

Reference will now be made in detail to the embodiments of the present disclosure, examples of which are illustrated in the accompanying drawings. Although embodiments have been described with reference to a number of illustrative embodiments thereof, it should be understood that numerous other modifications and embodiments can be devised by those skilled in the art that will fall within the spirit and scope of the principles of this disclosure.

The following will describe a refrigerator according to an embodiment.

Figure 1:
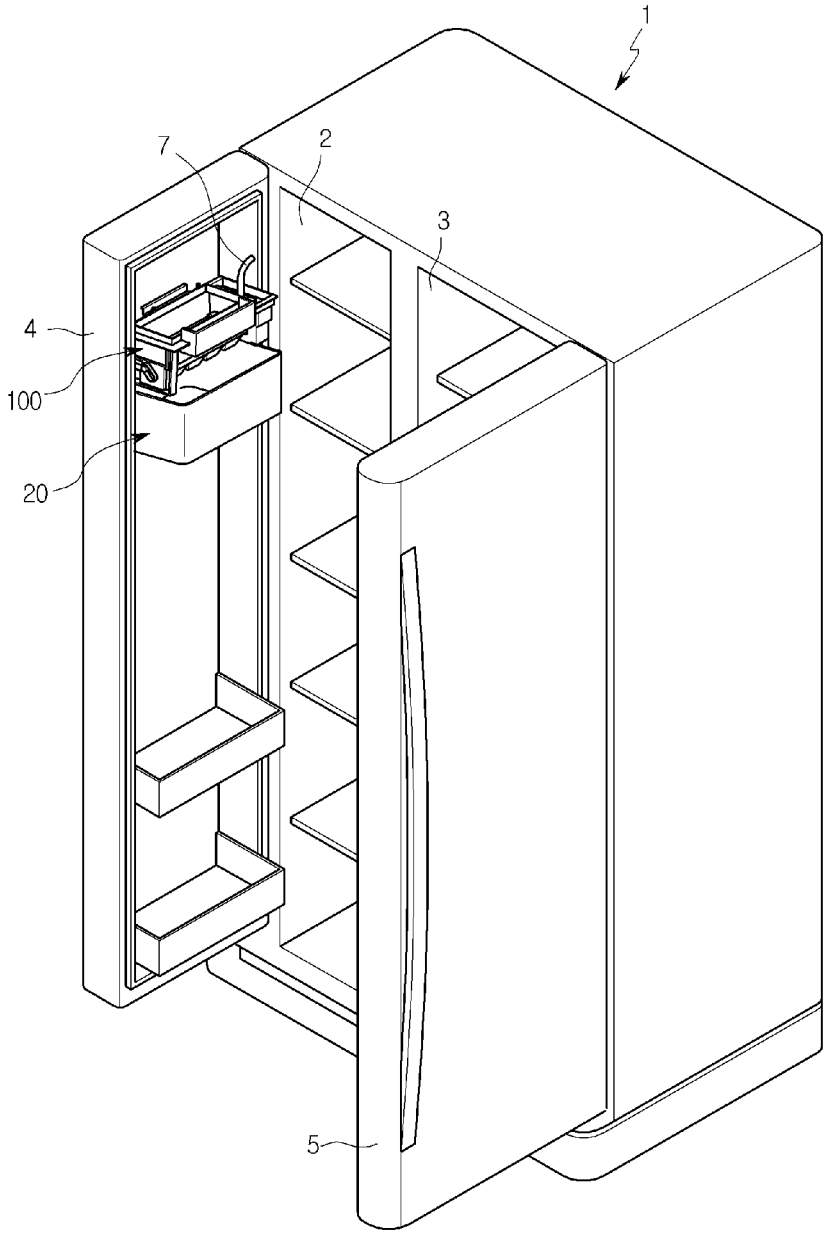
FIG. 1 is a perspective view of a refrigerator according to an embodiment.

FIG. 1 is a perspective view of a refrigerator according to an embodiment.

Referring to FIG. 1, two storing compartments 2 and 3 are defined in a main body 1 of a refrigerator. One of the storing compartments 2 and 3, for example, the storing compartment 2, may be a freezing compartment, and the other storing compartment, for example, the storing compartment 3, may be a refrigerating compartment. Needless to say, both of the storing compartments 2 and 3 may be freezing compartments.

Doors 4 and 5 for opening/closing the respective storing compartments 2 and 3 are provided on a front portion of the main body 1. The doors 4 and 5 are installed to be opened and closed while rotating about respective hinge portions. The doors may be formed in a drawer type that can be horizontally opened and closed. In FIG. 1, a side-by-side refrigerator having two door that can be opened and closed at both sides. A structure where upper and lower spaces of each of the storing compartments 2 and 3 are opened and closed by different doors may be applied.

An icemaker 100 is disposed in the freezing compartment door 4. However, the icemaker 100 may be disposed in one of the freezing and refrigerating compartment doors 4 and 5. When the icemaker 100 is disposed in the refrigerating compartment door 5, the icemaker 100 must be isolated from cool air of the refrigerating compartment 3 by a thermal insulation case and sub-zero air must be supplied from the freezing compartment 2 to the icemaker 100. However, when the icemaker 100 is installed in the freezing compartment door 4, no thermal insulation case is required. The following will describe a case where the icemaker 100 is installed in the freezing compartment door 4.

An ice bank 20 for storing ice discharged from the icemaker 100 is disposed under the icemaker 100. The ice bank 20 may be installed to be capable of being pulled. An ice crusher (not shown) for crushing the ice may be disposed in the ice bank 20.

A water supply hose 7 for supplying water to the icemaker 100 is installed in the door 4. The water supply hose 7 is disposed above the icemaker 100. The water supply hose 7 is connected to a water supply unit (not shown).

Figure 2:
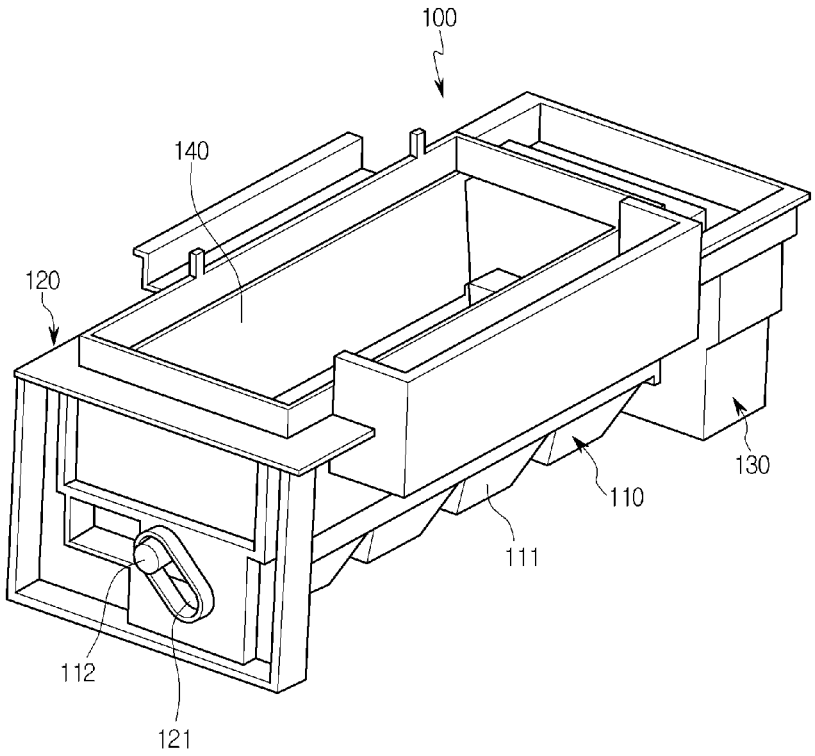
FIG. 2 is a perspective view of an icemaker installed in a door of the refrigerator of FIG. 2.
Figure 3:
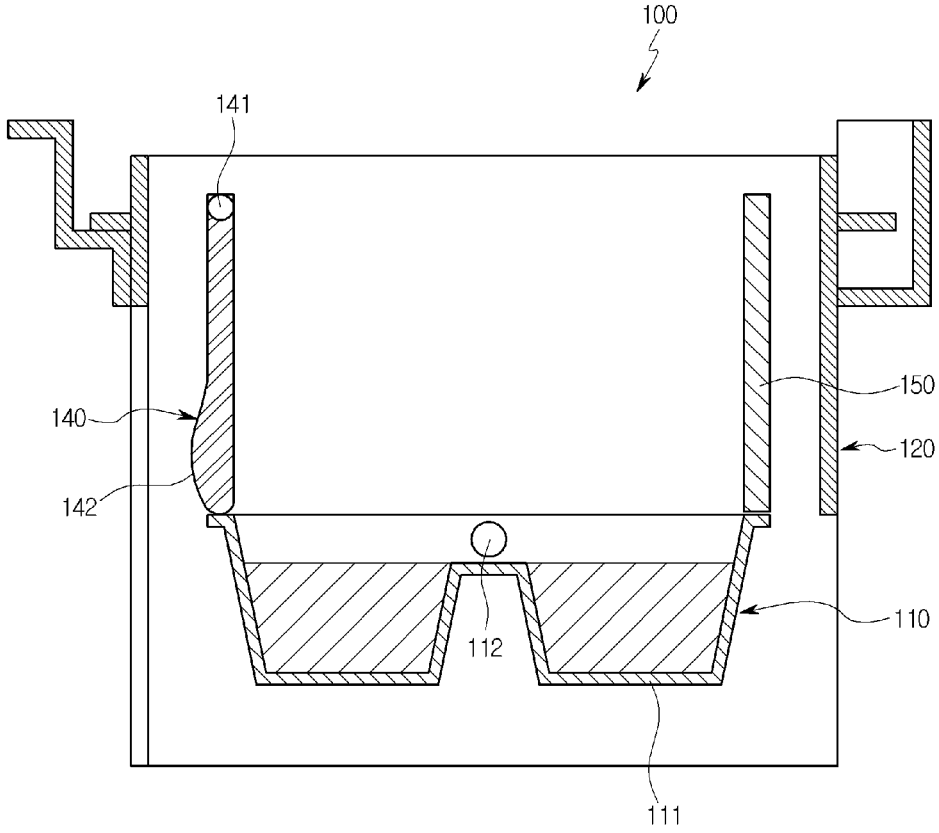
FIG. 3 is a sectional view of the icemaker of FIG. 1.

FIG. 2 is a perspective view of the icemaker installed in the door of the refrigerator of FIG. 2 and FIG. 3 is a sectional view of the icemaker of FIG. 1.

Referring to FIGS. 2 and 3, the icemaker 100 includes a tray that is installed to be capable of rotating.

A frame 120 may be disposed around the tray 110. At this point, the tray 110 is supported by the frame 120 to be capable of rotating. Alternatively, the tray 110 may be directly installed on the door 4 to be capable of rotating. The following will describe a case where the tray 110 is supported by the frame.

A driving unit 130 is coupled to a side of the tray 110. The driving unit 130 is disposed at a side of the frame 120. The driving unit 130 may include a motor (not shown) and a control panel (not shown). The driving unit 130 may be formed in a variety of structures that can automatically rotate the tray 110. A detailed description of a structure of the driving unit 130 will be omitted herein.

The tray 110 may be formed in a twisting type that can separate ice by being twisted. Alternatively, the tray 110 may be formed in a heating type that can separate the ice using a heater disposed on a bottom surface of the tray 110. The twisting type tray may be formed of a flexible material. In addition, the heating type tray may be formed of a material having an excellent thermal conductivity so that freezing cold air can be conducted through the tray. In this embodiment, a variety of trays that can rotate can be applied. The following will describe the twisting type tray by way of example.

The tray 110 is designed to form a plurality of ice cubes that are individually made. The ice cubes may be formed in a variety of desired shapes.

A rotational shaft 112 is formed on an opposite side of the tray 110 to the driving unit 130. At this point, the frame 120 is provided with a supporting portion 121 to which the rotational shaft 112 of the tray 110 may be coupled to be capable of rotating. The supporting portion 121 is formed in an inclined slot. Therefore, when the tray 110 rotates, the rotational shaft 112 of the tray 110 moves on the supporting portion 121, in the course of which the tray 110 is twisted.

A water overflowing preventing member 140 that prevents the water from overflowing the tray 110 when the door 4 is opened and closed is disposed around the tray 110. The water overflowing preventing member 140 rotates together with the tray 110 when the tray 110 rotates. The water overflowing preventing member 140 is provided in the form of a panel having a length that is almost identical to that of the tray 110.

An upper portion of the water overflowing preventing member 140 may be coupled by a hinge portion 141. At this point, the water overflowing preventing member 140 is returned to its initial position by self-gravity when the tray 110 rotates. For example, in a state of FIG. 2, when the tray 110 rotates clockwise, the water overflowing preventing member 140 is disposed at a left side of the tray 110.

Further, the water overflowing preventing member 140 may be disposed near the door 4 or at an opposite side of the door 4. That is, since the water jiggles greatly to an opening side and an opposite side of the opening side, the water overflowing preventing member 140 may be disposed at an opening side or an opposite side of the opening side.

A lower portion of the water overflowing preventing member 140 may be disposed contacting a top surface of an edge of the tray 110. At this point, a rounded portion 142 is formed on the lower portion of the water overflowing preventing member 140 to minimize friction with the tray 110.

The water overflowing preventing member 140 may be disposed on the frame 120 to be capable of rotating. However, the water overflowing preventing member 140 may not be disposed on the frame 120. In this case, the water overflowing preventing member 140 may be rotatably coupled to the door 4.

Meanwhile, a water overflowing preventing panel 150 may be disposed at an opposite side to the water overflowing preventing member 140. The water overflowing preventing panel 150 is fixed on the frame 120 such that it does not rotate when the tray 110 rotates.

Further, the water overflowing preventing panel 150 may not be provided. In this case, a surface of the tray 110, which is opposite to the water overflowing preventing member 140, closely contacts the frame 120.

An operation of the embodiment will be described hereinafter.

Figure 4:
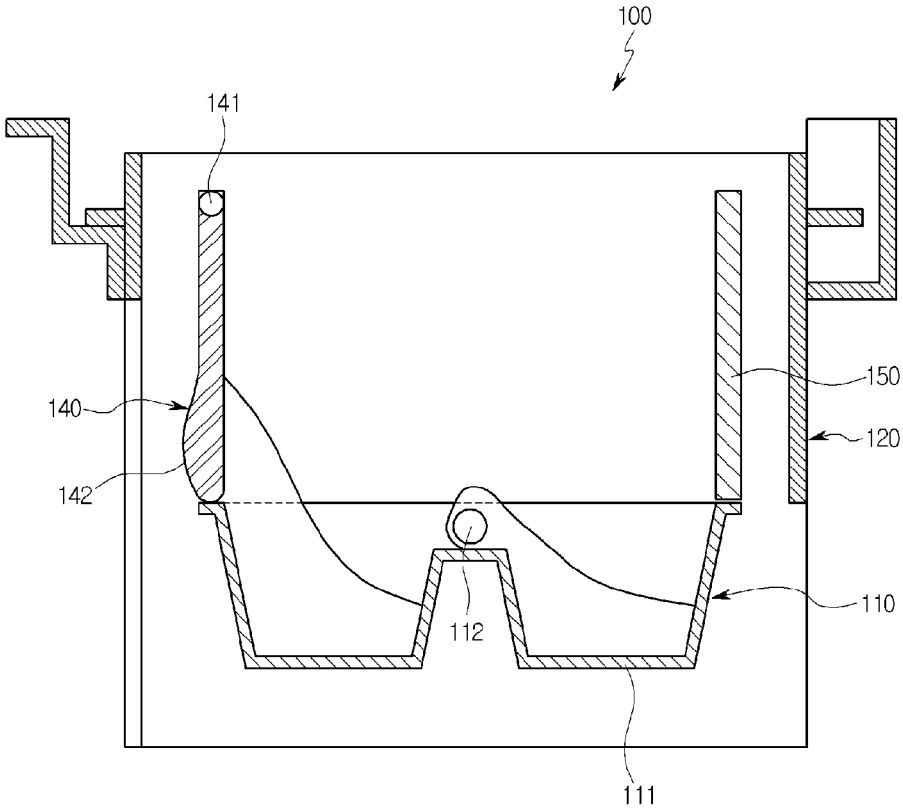
FIGS. 4 through 6 are sectional views illustrating an operation of the icemaker of FIG. 2.
Figure 5:
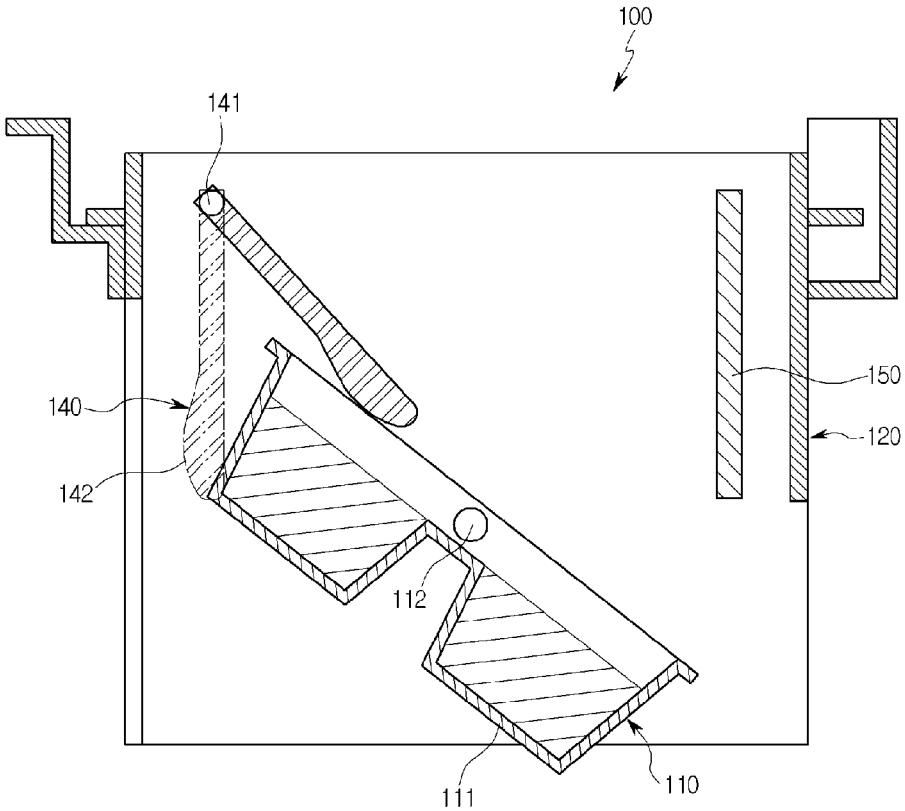
Figure 6:
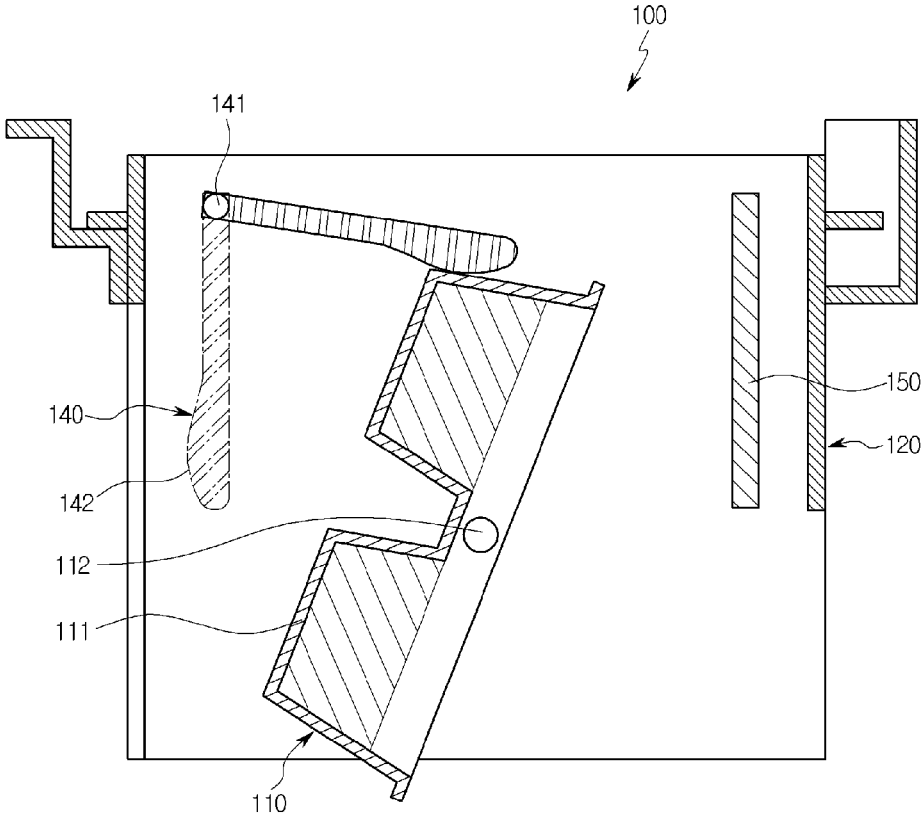

FIGS. 4 through 6 are sectional views illustrating an operation of the icemaker of FIG. 2.

Referring to FIG. 4, the water is supplied to the tray 110 along the water supply hose 7. The freezing cold air of the storing compartment is provided to the tray 110. When the user opens the door 4 before the water is frozen, the water of the tray 110 may jiggle to overflow the tray 110 by external impact. At this point, the overflowing of the water may be prevented by the water overflowing preventing member 140. When the water jiggles to an opposite side, the overflowing of the water may be prevented by the water overflowing preventing panel 150. The door 4 can be freely opened and closed regardless the water supplied to the tray 110 is frozen or not.

Referring to FIG. 5, the driving unit 130 determines if the water supplied to the tray 110 is sufficiently frozen. When it is determined that the water is sufficiently frozen, the driving unit 130 rotates the tray 110. At this point, by the rotation of the tray 110, the lower portion of the water overflowing preventing member 140 is pressed, after which the water overflowing preventing member 140 rotates together with the tray 110. Further, the water overflowing preventing panel 150 does not rotate.

Referring to FIG. 6, when the driving unit 130 further rotates the tray 110, the ice cubes of the tray 110 are discharged from the tray 110 and stored in the ice bank 20.

By the above-described operation, the overflowing of the water can be prevented when the door 4 is opened and closed and the ice cubes are discharged from the tray 110 when the water is frozen in the tray 110.

The following will describe an icemaker according to another embodiment.

Figure 7:
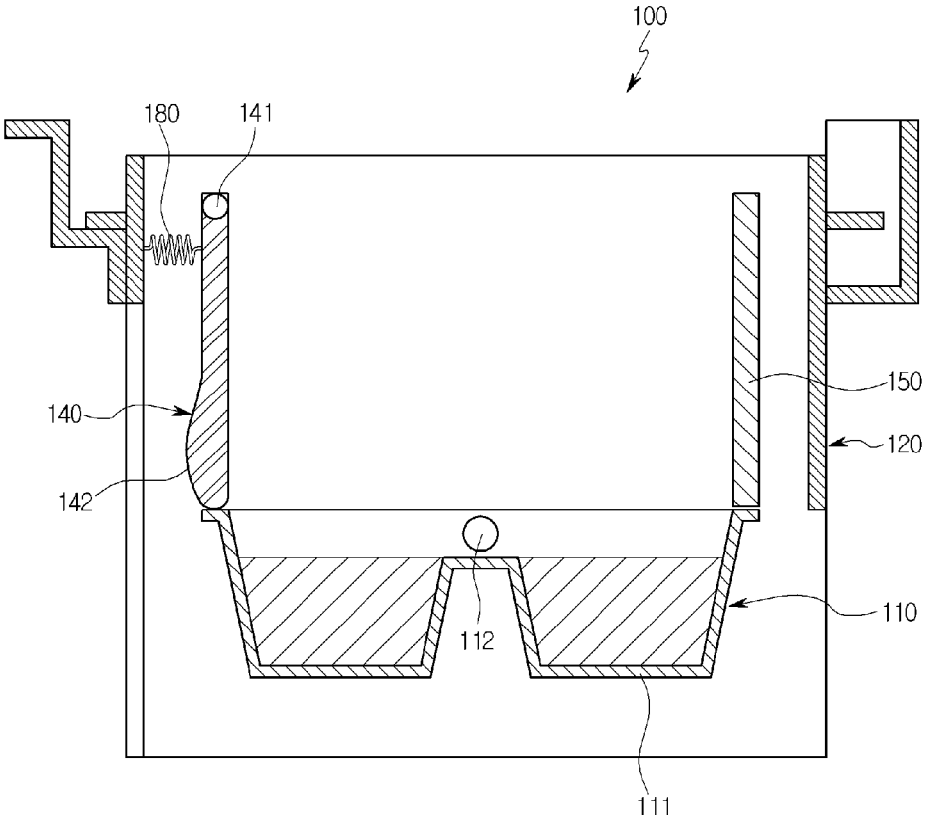
FIG. 7 is a sectional view of an icemaker according to another embodiment.

FIG. 7 is a sectional view of an icemaker according to a second embodiment.

Referring to FIG. 7, a feature of this embodiment is that an elastic member 180 is installed on a water overflowing preventing member 140. The elastic member 180 biases the water overflowing preventing member 140 to an initial position when the water overflowing preventing member 140 rotates. A coil spring or a torsion spring may be used as the elastic member 180. In this embodiment, components identical to those of the foregoing embodiment are assigned with same reference numbers and a description thereof will be omitted herein.

Various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

According to the present disclosure, the overflowing of the water can be prevented when the door is opened and closed and the ice cubes are discharged from the tray by the rotation of the tray. Therefore, the industrial applicability of the present disclosure is remarkable.

INDUSTRIAL APPLICABILITY

According to an embodiment, noise of the air conditioner can be reduced and the installation and design of freedom can be improved. Hence, the industrial applicability is very high.

The invention claimed is:

1. An icemaker, comprising:

a tray rotatably installed on a door, the tray having an open top;

a driver that rotates the tray;

a frame to which the tray is rotatably coupled; and a water overflowing preventing member provided at one side of the tray to prevent water in the tray from overflowing, wherein the water overflowing preventing member extends in a longitudinal direction at the open top of the tray such that the water overflowing preventing member does not block the open top of the tray, wherein the water overflowing preventing member comprises:

a first upper portion that includes a hinge portion coupled to the frame;

a first lower portion that extends from the first upper portion downward to rotate on the hinge portion such that when the tray rotates, the first lower portion rotates with the tray, wherein the first lower portion includes a distal end that is detachably contactable with a surface of a first side of the open top of the tray, the distal end of the first lower portion being pushed up by the surface of the first side of the open top of the tray when the tray rotates; and a panel that extends in a longitudinal direction at the open top so as not to block the open top, the panel comprising:

a second lower portion including a distal end that is laid on a surface of a second side of the open top, the second side of the open top being opposite to the first side thereof; and a second upper portion that extends from the second lower portion upward, wherein the second lower portion and the second upper portion are fixed to the frame so as not to rotate, and wherein the distal end of the second lower portion is spaced apart from the surface of the second side of the open top when the tray rotates.

2. The icemaker according to claim 1, wherein the water overflowing preventing member is returned to an initial position by gravity when the tray is returned to an initial position.

3. The icemaker according to claim 1, further comprising an elastic member that biases the water overflowing preventing member to an initial position of the water overflowing preventing member, and wherein the elastic member connects the frame with the first upper portion of the water overflowing preventing member.

4. The icemaker according to claim 1, wherein the driver is disposed at one side of the frame.

5. The icemaker according to claim 4, wherein the tray includes a rotational shaft provided on a side of the tray that is opposite to the driver, and wherein the frame includes a supporting portion on a side of the frame opposite to the driver to which the rotational shaft of the tray is movably coupled.

6. The icemaker according to claim 5, wherein the supporting portion of the frame comprises an inclined slot in which the rotational shaft of the tray moves when the tray is rotated by the driver such that the tray is twisted.

7. The icemaker according to claim 1, wherein the water overflowing preventing panel is disposed at a side of the frame opposite to a side at which the water overflowing preventing member is provided.

8. The icemaker according to claim 1, wherein the first lower portion moves on an outer surface of the tray when the tray rotates.

9. The icemaker according to claim 1, wherein the distal end of the first lower portion of the water flowing preventing member comprises a rounded portion that minimizes friction with the tray.

* * * * *